US006420025B1

(12) United States Patent
Müller et al.

(10) Patent No.: US 6,420,025 B1
(45) Date of Patent: Jul. 16, 2002

(54) METHOD FOR PRODUCING ULTRA-FINE SYNTHETIC YARNS

(75) Inventors: Andreas Müller, Flörshewim-Dalsheim; Reinhard Wagner, Saalfeld/Saale; Dietmar Wandel, Hanau; Heinz Schuettrichkeit, Kelsterbach, all of (DE)

(73) Assignee: Zimmer Aktiengesellschaft, Frankfurt am Main (DE)

( * ) Notice: Subject to any disclaimer, the term of this patent is extended or adjusted under 35 U.S.C. 154(b) by 0 days.

(21) Appl. No.: 09/958,169

(22) PCT Filed: May 2, 2000

(86) PCT No.: PCT/EP00/03975

§ 371 (c)(1),
(2), (4) Date: Oct. 4, 2001

(87) PCT Pub. No.: WO00/70132

PCT Pub. Date: Nov. 23, 2000

(30) Foreign Application Priority Data

May 14, 1999 (DE) ..... 199 22 240

(51) Int. Cl.[7] ..... D01F 6/00; D01F 7/04; D01D 5/16; D01D 5/08

(52) U.S. Cl. ..... 428/364; 428/364; 428/395; 204/210.8; 204/211.14; 204/211.18

(58) Field of Search ..... 264/210.8, 211.14, 264/211.18, 235, 237; 428/364, 395

(56) References Cited

U.S. PATENT DOCUMENTS 4,181,697 A * 1/1980 Koschinek et al. ..... 264/176 F
4,374,797 A * 2/1983 Koschinek et al. ..... 264/210.3
4,436,688 A * 3/1984 Koschinek et al. ..... 264/176 F

* cited by examiner

*Primary Examiner*—N Edwards
(74) *Attorney, Agent, or Firm*—Herbert Dubno

(57) ABSTRACT

A process of producing a synthetic ultrafine endless yarn on the basis of polyester or polyamide in the range from 0.25 to 0.9 denier per POY filament by melt spinning at draw-off speeds between 2000 and 6000 m/min with a high spinning safety. To the polyester or polyamide a second immiscible amorphous polymer may be added in an amount of 0.05 to 5 wt %. One feature of the invention is the adjustment of a balanced temperature profile in the cross-section of the filament bundle before reaching the draft zone, as well as the suitable adaptation between snap-back length and the draft point of the filaments in the quench duct.

11 Claims, 2 Drawing Sheets

METHOD FOR PRODUCING ULTRA-FINE SYNTHETIC YARNS

DESCRIPTION

Figure 1:
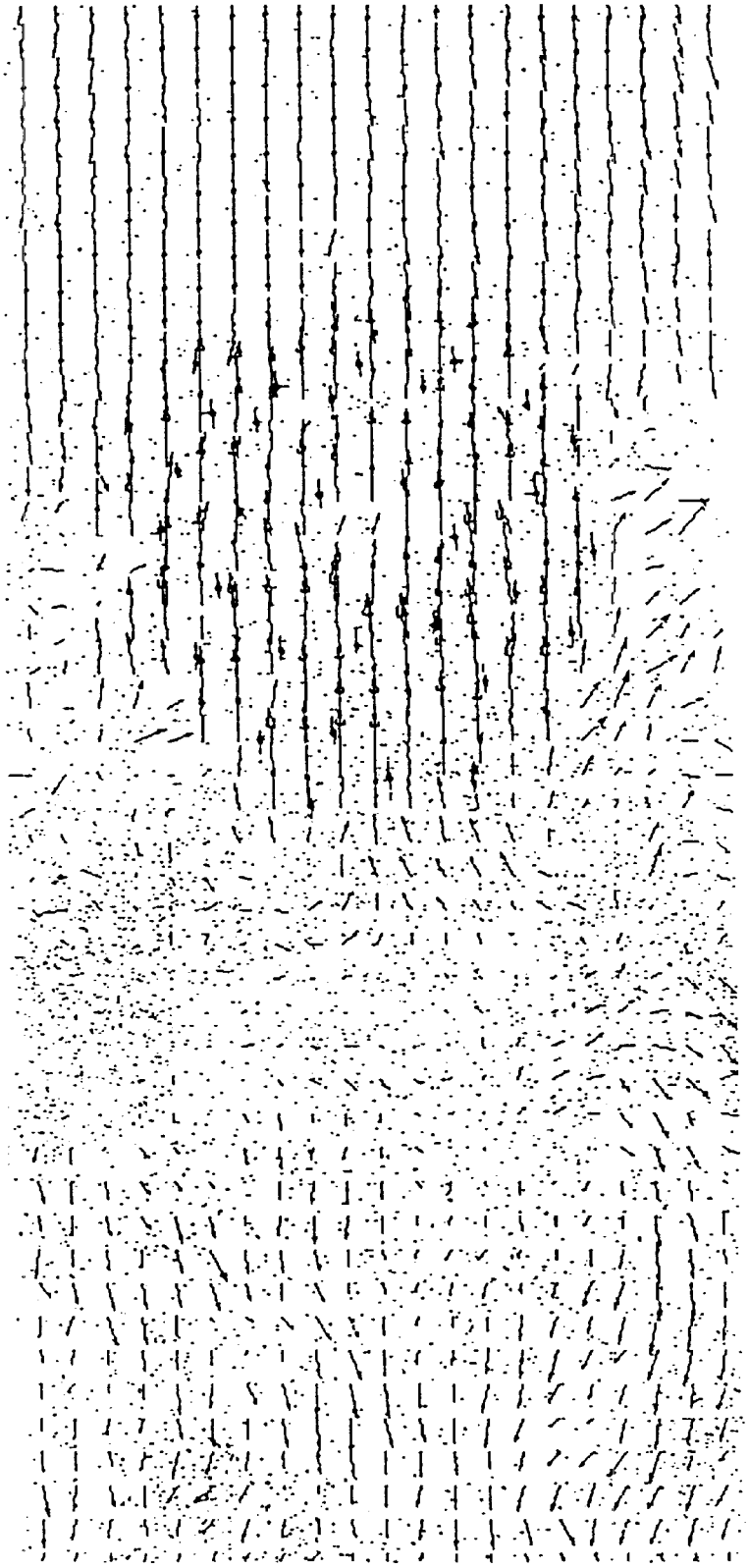

The present invention relates to a process of producing a synthetic ultrafine endless yarn on the basis of polyester or polyamide in the range from 0.25 to 0.9 denier per POY filament by melt spinng at draw-off speeds between 2000 and 6000 m/min. To the polyester or polyamide a second immiscible amorphous polymer may be added in an amount of 0.05 to 5 wt %.

Several authors have dealt with the problems in the production of fine and ultrafine filaments:

In "Advanced Fiber Spinning Technology" (Woodhead Publishing Ltd., 1994, p. 191), Nakajima describes a process of spinning ultrafine fibers, the filaments being quenched directly upon spinning in addition to the normal cross-flow quenching by means of a radially directed cold stream of air.

Tekaat (publication on the "Internationale Chemiefasertagung" in Dornbirn 1992, p. 8) describes studies in the production of microfilament yarns. It was found out that in the case of high filament counts the blow air can only hardly penetrate through the thread bundle, and the filaments in the middle cool down much later than the filaments close to the edge.

According to Ziabicki ("Fundamentals of Fibre Formation", J. Wiley & Sons), 1976, p. 196 ff. and p. 241), the cooling conditions directly below the nozzle package are decisive for the thread quality. In addition, the bundle of threads exerts a considerable resistance to the flow, which may lead to the fact that the blow air flows around the bundle instead of flowing through the same.

For producing microfibers, some patents propose an additional heating of the filaments with heating gas or with radiant heating:

U.S. Pat. No. 5,310,514 (Corovin) claims a process of producing microfilaments, wherein for protecting the freshly spun filaments a stream of hot air flows out of an annular slot in the nozzle package parallel to said filaments. The temperature of the hot air is about ±10 K of the melt temperature. The technical design is very complex and the constancy of the air stream necessary in this critical range is hard to ensure.

EP 0 455 897 A (Karl Fischer) describes a process of heating the individual filaments via a system of passages inside the nozzle plate, through which hot air is passed. This should improve the draft of the filaments. A compensation of the heat losses of the filaments close to the edge is not possible. In this case, the hot gas flows around each filament individually. This should promote the draft of the thread. The temperatures may lie in the range of the melt temperature or above.

GB patent 1,391,471 (Hoechst) describes a heater for technical yarns. With this heater, a yarn of low prestretch orientation can be produced with an increased throughput. The apparatus consists of two conical shells, the lower one of which is heated, and the upper polished shell of which reflects a large part of the thermal radiation onto the filaments. It is expressly pointed out that only little radiation should impinge on the nozzle plate. The temperature profile along the heating section is greatly parabolic with a maximum approximately at half the running length (about 120 K above the melt temperature).

U.S. Pat. No. 5,661,880 (Barmag) claims a radiant heating of the filaments discharged from the spinneret. There is described a process for stretch-spinning with a conical heating section. With preferably 450–700° C., the temperature on thee heating surface distinctly lie above the melt temperature. There is also claimed a heating of the nozzle plate by heating bands extending in or on the same. The contact time available for the heat transfer to the melt is thus reduced to a few seconds. No distinction is made between a heating of the inner and outer melt flows. A premature orientation of the melt in the nozzle capillaries should thus be prevented. In addition, deposits on the nozzle should be reduced and the throughput should be increased.

U.S. Pat. No. 5,182,068 (ICI) describes a process which should reduce necking at draw-off speeds above 5000 m/min. It is stated that a heated snap-back with a constant temperature profile (3000) over the running length only effects a shift of the neck point, whereas a snap-back with progressively decreasing temperature profile (300→200° C.) leads to a distinct defusing of the neck point. The thread speed before necking is increased, and the neck-draw ratio before/after necking is decreased. There are claimed speeds above 7000 m/min.

GB patent 903,427 (Inventa) describes a spinning tube with a length of at least 1 m, in whose upper portion there is a temperature of 10–80 K below the melt temperature. The temperature in the lower tube portion is less than 100° C. Heating may be effected either directly or via a heat transfer medium.

U.S. Pat. No. 5,250,245 (DuPont) describes a spin orientation process for producing fine polyester filaments with improved mechanical properties and uniform titers. This is achieved by choosing a suitable polymer viscosity and correspondingly adapted spinning conditions.

U.S. Pat. No. 4,436,688 (Zimmer) claims a process with draw-off speeds between 600 and 6000 m/min, wherein the spun filaments perform a snap-back. The length thereof depends on the draw-off speed and the filter surface load.

U.S. Pat. No. 5,866,050 (DuPont) discloses a heating of the spinning package such that the filaments emerge from the nozzle bores with almost the same temperature. The process does not consider the different cooling behavior of the middle and outer filaments in particular with very fine and highly capillary titers.

For the heat conduction of the filaments directly upon extrusion, different methods are proposed in the above-mentioned references. Some of these methods have the disadvantage that they impair the formation of a stagnation zone directly after the extrusion of the thread by supplying a heating gas. However, this stagnation zone is absolutely necessary for achieving a high evenness of the yarn.

Many of the above-mentioned processes employ the radial or unilateral supply of heat to the filaments, which leads to the fact that in particular the outer filaments are subject to a decrease in tension, which deteriorates the running smoothness and thus reduces the evenness of the yarn.

The difference in the cooling behavior between inner and outer filaments is decisive for the running stability. It should therefore be possible to adapt the temperature profile of the emerging filaments in dependence on the polymer throughput. To influence the temperature profile of the filaments that have emerged already such that this cooling behavior is prevented has so far not been taken into account by the prior art.

What is still problematic is the question how low breakage rates can be achieved in the POY. It is the object of the invention to achieve an evenness with ultrafine yarns (about 0.25–0.89 dpf) as it can be achieved with the current method principle in the commonly used production of high-count yarns (about 1.0–1.2 dpf).

The quenching systems most frequently used in practice are based on a unilateral quenching, in order to facilitate access. It should be possible to utilize this principle of the unilateral quenching.

In accordance with the invention, the solution of this object is effected by a process and a yarn as stated in the claims.

The solution of this object is achieved by the complex cooperation of several essential process steps. Subsequently, the individual process steps for the production of ultrafine microfibers will be described from the extrusion of the melt to the take-up of the POY yarn.

As raw material, there is used a polyester such as polyethylene terephthalate (PET), polypropylene or polybutylene terephthalate or polyamide such as PA 6 or PA 6.6 or copolymers thereof. There is preferably used PET with an intrinsic viscosity between 0.59 and 0.66 dl/g. A sufficient structural homogeneity and a sufficient thermal homogeneity of the melt before reaching the spinning package must be ensured.

To the base polymer, a second immiscible amorphous polymer may be added in an amount of 0.05 to 5 wt %. The added polymer preferably is a copolymer which is composed of at least two of the following monomer units: 0 to 95 wt % A, wherein A is a monomer of the formula $CH_2{=}C(R)—COOR^1$, with R equal to —H or —$CH_3$ and $R^1$ equal to straight-chain or branched $C_{1-10}$ alkyl or cyclohexyl, 0 to 40wt % B, wherein B is a monomer consisting of maleic acid or maleic anhydride, and 5 to 85 wt % C, wherein C is a monomer consisting of styrene or methyl-substituted styrene, and wherein (wt % A+wt % B+wt % C)=100.

By means of the inventive process, POY filament titers of 0.25–0.9 denier, corresponding to a final filament titer of the stretched yarn of 0.15 to 0.52 denier, can be achieved. The elongation at break in the PET POY lies in the range from 100 to 145%, and the specific breaking strength lies in the range between 18 and 33 cN/tex. There are used take-off speeds between 2000 and 6000 m/min. A few inventive characteristic process parameters for polyester (PET) are listed in Table 1.

TABLE 1

| | Test 1 | Test 2 | Test 3 | Test 4 | Test 5 |
|---|---|---|---|---|---|
| Draw-off speed $V_{draw\text{-}off}$ [m/min] | 2570 | 2575 | 2565 | 2570 | 4150 |
| Melt throughout $m_{nozzle}$ [g/min] | 23.5 | 17.5 | 19.1 | 35.3 | 36.4 |
| Amount of melt throughput, modifier [wt-%] | — | — | — | — | 0.55 |
| Final filament titer [dpf] | 0.26 | 0.26 | 0.21 | 0.26 | 0.26 |
| Number of filaments n [-] | 192 | 144 | 192 | 288 | 144 |
| Hole density [$cm^{-2}$] | 3.2 | 2.4 | 3.2 | 3.0 | 2.4 |
| Capillary bore of nozzle plate $d_{cap}$ [mm] | 0.1 | 0.12 | 0.1 | 0.1 | 0.12 |
| Filter area of nozzle package [$cm^2$] | 60.8 | 60.8 | 60.8 | 100.0 | 60.8 |
| Spinning draft [-] | 195 | 283 | 239 | 195 | 220 |
| Extrusion speed $V_{extrusion}$ [m/min] | 13.2 | 9.1 | 10.7 | 13.2 | 18.9 |
| Filter surface load $f_{filter}$ [g/min/$cm^2$] | 0.39 | 0.29 | 0.31 | 0.35 | 0.60 |
| Wall shear rate of nozzle capillary $\gamma_{cap}$ [$s^{-1}$] | 17600 | 10100 | 14300 | 17600 | 21100 |

The relationships between the individual parameters can be determined according to the following calculation formulae:

$$Draft = \frac{v_{draw\text{-}off} \cdot \rho_{melt} \cdot n \cdot \frac{\pi}{4} \cdot d_{cap}^2}{\dot{m}_{nozzle}}, \quad v_{extrusion} = \frac{\dot{m}_{nozzle}}{\rho_{melt} \cdot n \cdot \frac{\pi}{4} \cdot d_{cap}^2},$$

$$f_{filter} = \frac{\dot{m}_{nozzle}}{\frac{\pi}{4} \cdot d_{filter}^2}, \quad (\alpha_{filter} \text{ in[cm]})$$

As nozzle package there is used for instance a round package corresponding to U.S. Pat. No. 5,304,052 or U.S. Pat. No. 5,795,595. By means of components, the dwell time of the melt inside the package is adjusted such that it is not longer than 12 minutes and not shorter than 5 minutes. As filtration medium there is used a sequence of different fabric layers with microfine mesh sizes of 5 to 15 $\mu$m in combination with or without fine steel sand with a grain size of 88 to 250 $\mu$m.

To ensure a high polymer homogeneity, a sufficient shear or comminution of the higher-molecular gels present in the melt is necessary, which may be effected either by fine steel sand or by corresponding components in the spinning package with microfine pore holes of 50 to 1000 $\mu$m. The total package pressure was adjusted such that at least 105 bar were achieved with filter surface loads of 0.25 to 0.80 g/min/$cm^2$.

What turned out to be critical was the use of the fine nozzle bores necessary for the process. In the case of multi-layer nozzle filters, disturbing particles inside the nozzle filters and in particular in the vicinity of the filter frame cannot definitely be excluded. This problem was overcome by using fine loose filter layers of metal gauze with a fineness larger than 4,000 mesh/$cm^2$, preferably larger than 15,000 mesh/$cm^2$ (40 $\mu$m mesh size) directly on the nozzle plate. This ensures the necessary safety at spinning start.

The hole density of the nozzle plates used can be adjusted between 1.5 and 6.0 hole/$cm^2$. The diameter d of the capillary bores in the nozzle plate is chosen such that the apparent wall shear rate of the melt inside the capillaries lies between 5,000 and 25,000 $s^{-1}$ (for PET see Table 2). This ensures an additional heating of the melt.

TABLE 2

| Throughput per capillary bore [g/min] | Wall shear rate $\gamma$ [$s^{-1}$] | Diameter d of capillaries [mm] | Length L of capillaries [mm] | Pressure $\Delta\rho_{cap}$ before nozzle plate [bar] |
|---|---|---|---|---|
| 0.1224 | 17600 | 0.1 | 0.30 | 93 |
| 0.0990 | 19600 | 0.09 | 0.20 | 72 |
| 0.2448 | 20400 | 0.12 | 0.30 | 83 |
| 0.1215 | 10100 | 0.12 | 0.45 | 86 |

The following relationships are applicable:

$$\dot{\gamma} = \frac{533 \cdot \dot{m}_{fil.}}{\rho_{melt} \cdot \pi \cdot d_{cap}^3}, \qquad \dot{m}_{fil.} = v \cdot dpf_{POY}, \qquad d_{cap} = \sqrt[3]{\frac{533 \cdot \dot{m}_{fil.}}{\rho_{melt} \cdot \pi \cdot \dot{\gamma}}}$$

$$L = 1930 \cdot \frac{\rho_{melt} \cdot d_{cap}^4}{\dot{m}_{fil.} \cdot (\eta_1 - \eta_2 \cdot \log\dot{\gamma})} \cdot \Delta p_{cap} \text{ [mm]},$$

$$\eta_1 = 3510 \qquad \eta_2 = 690$$

The capillary diameter is chosen between 0.08 mm and 0.12 mm. The diameter of the individual capillary bores in the nozzle plate need not be constant over the cross-section of the nozzle plate, but can be adapted inversely proportional to the temperature gradient as measured on the surface of the nozzle plate. The difference between central bores and bores close to the edge is not more than 0.2 d, preferably 0.1 d. In this range of diameters, the exit speeds are limited by two effects: On the one hand, a sufficiently high extrusion speed of at least 7 m/min is necessary to avoid the risk of cohesive breakages. On the other hand, an upper limit of 20 m/min should not be exceeded, as otherwise flow anomalies can occur, which are characterized by an irregular discharge of melt from the capillary bore (corkscrew effect).

The length L of the capillaries is chosen such that a sufficiently high melt pressure is achieved with the necessarily low filter surface load before the nozzle plate. There are enough pressure reserves for a uniform radial distribution of the melt. The pressure before the nozzle plate should lie between 50 and 100 bar, preferably between 70 and 100 bar. In dependence on the melt throughput per capillary bore, an L/d ratio between 2 and 5 can for instance be chosen (see Table 2).

Figure 2:
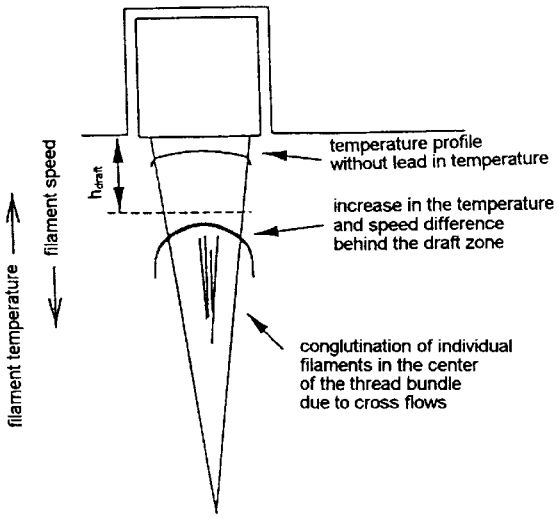

What was recognized as essential for a stabilization of the spinning safety is the adjustment of a balanced temperature profile in the cross-section of the thread bundle before reaching the draft zone. It is known that filaments are drawn upon reaching the glass transition temperature $T_g$ Filaments starting with different temperatures will reach the temperature suitable for a draft ($T_{melt}<T<T_g$) under constant cooling conditions also at different distances from the nozzle plate. It is, however, conclusive that the filaments close to the edge will cool at a faster rate than the filaments in the center of the thread bundle, as they are in a more direct contact with the ambient air (see FIG. 2). For adjusting a balanced temperature profile at a certain distance from the nozzle plate, it is therefore not sufficient to subject all filaments to the same starting temperature. Rather, the outer filaments should have a lead in temperature with respect to the central filaments, which are adjusted just such that the temperatures of the filaments close to the edge and of the central filaments have adapted to each other shortly before reaching the draft zone.

($T_{edge}-T_{center}$), as measured as surface temperature difference on the nozzle plate between the center and the edge of the nozzle plate, can be adjusted in the claimed range of titers according to the following relationship via the temperature difference from spinning bar heating and polymer ($T_{heating}-T_{melt}$), in dependence on the filament through-put $m_{fil}$, the draw-off speed $V_{draw\text{-}off}$, and the filter area $A_{filter}$, as follows:

$$T_{heating} - T_{melt} = f \cdot (T_{edge} - T_{center}) \quad \text{with}$$

-continued $$f = 14{,}3 \cdot e^{\left(-2{,}2 \cdot \frac{\dot{m}_{fil}}{0{,}141\ \text{g/min}} \frac{2600\ \text{m/min}}{v_{draw-off}} \frac{61\ \text{cm}^2}{A_{filter}}\right)} \quad \text{and}$$

$$4\ \text{K} \le (T_{edge} - T_{center}) \le 13\ \text{K}.$$

What was surprisingly effective is the direct supply of the required heat via the wall of the nozzle package. Beyond the pure thermal losses of the nozzle plate additional heat was introduced into the spinning package for heating the melt close to the wall. This requires a correspondingly long dwell time in the nozzle package, which due to the low package throughput in the claimed range of titers could be adjusted with correspondingly shaped package components. The heat required for adjusting the desired temperature profile is transferred to the partial melt stream close to the wall through metallic conduction of heat in the nozzle package.

This partial melt stream close to the wall can either be heated to the required excessive temperature on the entire length H of the melt-contacted inner wall of the spinning package or only on a section l of the melt-contacted inner wall, the required excessive temperature $\Delta T_{melt\text{-}heating}$ then being increased corresponding to the area ratio H/l. This additionally heated surface should then preferably be provided in the lower part of the spinning package at the level of the nozzle plate and terminating with the lower edge of the nozzle plate in the form of a heating frame with through holes for the spinning packages and with a heating to be controlled independent of the spinning bar. A separate heating of the spinning bar and the product line is a prerequisite for adjusting the required temperature difference.

The formation of differently heated filaments in a plane transverse to the thread running direction has a great influence on the stability of the threadline. Differently heated filaments reach their final thread speed also at a different distance from the nozzle plate, so that cross-sections are obtained in which differently quick filaments are disposed at the same time, which due to their different suction effects cause turbulences inside the filament bundle. When drawing the yarn according to known methods, three speed ranges can be distinguished in principle:

1. The range before the draft zone: slow thread speed in the range from 7–200 m/min; an imbalanced temperature profile only has little influence on the absolute height of the speed differences.
2. The actual draft zone: speed range from 200 to about 2500 m/min; with an imbalanced profile, slow (not yet drawn) and quick (already drawn) filaments are present at the same time in this (fictitious) cross-section. Filaments close to the edge without lead in temperature reach their final speed much earlier than filaments in the center of the thread bundle. The consequence is an unsteady threadline, which is chiefly caused by the suction effect of the faster filaments sucking in the slower filaments. In the extreme case, individual filaments stick together, and thread breakages occur. The unsteady threadline has a distinct influence on the evenness of the yarn. Already existing irregularities are increased (see FIG. 2).
3. The range behind the draft zone: speed above 2500 m/min, different thread temperatures hardly have an influence on the spinning safety.

The draft zone extends up to the solidification point $h_{98\%}$ of the melt, which is defined such that here 98% of the thread draw-off speed are reached.

By our own examinations of the flow field in the vicinity of a unilaterally cross-flow-quenched thread bundle, the disadvantages of the unilateral quenching according to the above statements of Ziabicki were confirmed. The representation of the flow field was effected by means of a laser light section system of the firm ILA. In this method, the examination area is illuminated in various sectional planes by means of a powerful double-pulsed NdYAG laser. Into the blow air, an aerosol is charged, which reflects the laser pulses in the vicinity of the sectional plane. Visualization is effected with a high-resolution CCD video camera. The speed and the flow direction are represented by a vector field. The direction of the vector arrows is obtained from the spatial offset of the droplets, and the speed of the droplets is obtained from the spatial offset of the droplets and the time interval between two pulses. It was found that a unilateral quenching produces strong heterogeneities in the thread bundle. These are chiefly caused by the restricted flow zone before the thread bundle and by the turbulence area leeward of the thread bundle (see FIG. 1). These disadvantages are eliminated by means of the inventive process.

Figure 3:
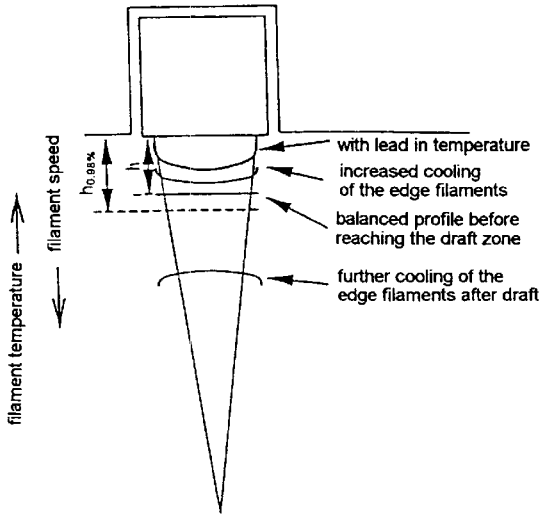

To this end (see FIG. 3), the distance h from the nozzle plate, on which a balanced temperature profile already exists due to the cooling of the filaments close to the edge, must be smaller than the distance of the solidification point from the nozzle plate (see FIG. 3). The adjustment is effected by the excessive increase in temperature of the melt heating for instance by means of laser Doppler anemometry. The thread speeds of filaments close to the edge and of central filaments are measured at the same time, whereas the temperature of the melt heating is adapted such that the speed difference between filaments close to the edge and central filaments becomes smaller than 40% of the draw-off speed of the yarn and preferably smaller than 15%. The measuring position is located directly above the draft zone, which in the claimed range of titers can be represented in dependence on the filament throughput $m_{fil}$ [g/min], the draw-off speed $V_{draw\text{-}off}$ [m/min] and the draft ratio VV, as follows:

$$h_{98\%} = 38 \cdot \frac{9000 \cdot \dot{m}_{fil}}{v_{draw-off} \cdot VV} \quad \text{where} \quad \cdot\left(\frac{9000 \cdot \dot{m}_{fil}}{v_{draw-off} \cdot VV} + 6,0\right) \text{ [mm]}$$

A too rapid cooling especially of the outer filaments must be prevented. Especially in this range of titers, however, the filaments cool down particularly fast, which is caused by the large specific surface. For a filament with 0.25 dpf, the relative surface of a filament, calculated according to the following relationship:

$$F_{fil} = \frac{40000}{d \cdot \rho_{melt}} \text{ [cm}^2\text{/g]}, \quad \text{where} \quad d = 11,9 \cdot \sqrt{\frac{dpf_{POY}}{\rho_{melt}}} \text{ [µm]}$$

is about 3 times as large as for a filament with 2 dpf.

In accordance with the invention, the still melt-liquid thread is therefore not directly exposed to the blow air, but is first of all cooled in a so-called snap-back. The solidification point of the yarn should not lie inside the snap-back, as due to the strong suction effect of the filaments, which especially in this range of titers starts quite early, large amounts of air are otherwise sucked into the snap-back, which causes turbulences in this area. On the other hand, the solidification point should not lie too far outside the snap-back, as otherwise the still melt-soft thread is exposed to the ambient air unprotected for too long.

Therefore, the solidification point is chosen such that it is just outside the protected snap-back. In this range of titers, the solidification point can specifically be adjusted by the temperature of the polymer. To this end, the absolute height of the product temperatures $T_{melt}$ and $T_{heating}$ (=$T_{melt}$+$\Delta T_{melt\text{-}heating}$) is adjusted for PET in a range from 290° C. to 318° C. At draw-off speeds between 2500 m/min and 3200 m/min, the absolute height of the necessary process temperature can be determined in dependence on the filter surface load according to the following relationship:

$$T_{melt}=308-25 \cdot f[^\circ \text{ C.}], \text{ where } f_{filter} in [\text{g/min cm}^2]$$

A general problem with the production of ultrafine microfilaments is the strong reaction of the spinning stability to heterogeneous temperatures. An additional radiant heating in the vicinity of the snap-back has turned out to be disturbing (poor evenness of the thread), probably due to a decrease of the thread tension in particular of the outer filaments, which thus become more sensitive to disturbances from the surroundings (air movement by beginning suction effect of the filaments). In the case of a radiant heating, the outer filaments are heated unilaterally, as that side of the filaments which faces the radiant surface is heated to an increased extent. Pictures taken with the laser section method revealed rapid air changes in the vicinity of the snap-back, which were caused by the already high speed of the filaments in this region. The build-up of a stationary, warm air cushion is impeded. Therefore, an active supply of heat from the out-side to the filaments is chiefly effected by radiation and not by convection.

On the other hand, a passive (non-heated) snap-back only prevents the outer filaments from cooling too quickly. The length of the passive snap-back cannot be chosen arbitrarily, but according to U.S. Pat. No. 4,436,688 is a function of the draw-off speed and the filter surface load, whose upper and lower limit is defined by the following relationships:

$$L_{max}=48,2 \cdot \log v_{draw\text{-}off}-109 \quad \text{[mm]}$$

$$L_{min}=34,4 \cdot \log v_{draw\text{-}off}-71 \quad \text{[mm]}$$

In this range, a suitable snap-back for the range of titers claimed in accordance with the invention was chosen.

Choosing a suitable snap-back is a prerequisite for the successful application of the present process, as is shown by the following examples (for PET) (Table 3):

TABLE 3

| Snap-back, heated/ unheated [mm] | Final titer [denier] | Uster, Normal Test [%] | Uster, Half Inert [%] | Elongation at break [%] | Elongation at break, CV [%] | Running properties |
|---|---|---|---|---|---|---|
| 30/80 | 0.26 | 1.98 | 1.43 | 131 | 3.6 | unsecure |
| 0/55 | 0.26 | 0.8 | 0.5 | 126 | 3.2 | good |
| −15/60 | 0.29 | 1.1 | 0.5 | 88 | 1.9 | very critical |

The example in the last line was realized by a protruding nozzle package. Although the values for the evenness of the thread lie at a good level, a very poor running behavior was achieved with this snap-back. This is due to the cooling of nozzle plate, which is also expressed by the low values of the elongation at break of the thread.

A high spinning safety is achieved by a careful temperature profile of the melt by adjusting the size of the heat-transferring surface, the heating temperature and the dwell time of the melt in the vicinity of the heating.

The transferable amount of heat is determined by the size of the heat-transferring surface and the contact time of the partial melt stream running on the outside, which contact time is available for the heat transfer with the inner wall of the package. A simple characteristic for the heat transfer can be defined from the ratio of contact length l and contact time t to be:

$$\frac{l}{t} = \frac{\dot{m}}{\rho_{melt} \cdot A_Q}$$

l describes the length of the inner wall of the package along which the partial polymer stream running on the outside in the package is heated to an excessive temperature, and t describes the contact time which is available for the heat transfer with the inner wall of the package. t is approximately described by the following relationship:

$$t = \frac{l \cdot A_Q \cdot \rho_{melt} \cdot \varepsilon}{n \cdot \dot{m}_{fil}}$$

where $\epsilon$ represents the part taken by the melt in a certain cross-section of the spinning package and can be constant in certain sections or be a function of the height.

For the amount of heat transferred, the following relationship is applicable e.g. for a round package:

$$\dot{Q}_{melt} = \frac{t \cdot \dot{m}}{\rho_{melt} \cdot A_Q} \cdot k \cdot \pi \cdot D \cdot \Delta T_{wall}$$

The following range turned out to be useful for spinning fine microfibers:

$$0,6 \ \frac{\text{cm}}{\text{min}} \leq \frac{l}{t} \leq 3,8 \ \frac{\text{cm}}{\text{min}}$$

The following range should preferably be achieved:

$$1,0 \ \frac{\text{cm}}{\text{min}} \leq \frac{l}{t} \leq 2,6 \ \frac{\text{cm}}{\text{min}}$$

Depending on the throughput, heights of 30 mm to 150 mm turned out to be useful. Even larger heights lead to excessively long dwell times with correspondingly negative influences on the breakdown of product. With a height of 115 mm and a contact time of 7 min a breakdown of product in the nozzle package of ΔIV=0.022 dl/g was obtained. The excessive temperature ($T_{heating}$–$T_{melt}$) adjusted was about 9 K. With a height of 50 mm and a contact time of 3 min, a breakdown of product in the nozzle package of ΔIV=0.020 dl/g was obtained for PET. The excessive temperature $\Delta T_{melt\text{-}heating}$ adjusted was about 21 K. In both cases, good spinning results were achieved.

The partial melt stream close to the wall is heated to the required excessive temperature either on the entire length H of the melt-contacted inner wall of the spinning package or only on a part of the melt-contacting inner wall with an excessive temperature ($\Delta T_{melt\text{-}heating} \times H/l$) which is increased corresponding to the area ratio H/l. This additionally heated surface should then preferably be provided in the lower part of the spinning package at the level of the nozzle plate in the form of a heating frame with a heating to be controlled independent of the spinning bar.

Surprisingly, the bicomponent crimp effect described by Fourné in "Synthetische Fasern", p. 310 (Carl Hanser Verlag, Munchen, Wien, 1995) was not observed in the claimed range of titers with this heating technique.

The blow air was adjusted just such that the speed of the blow air supplied corresponded to the speed of the air sucked in by the filaments from the surroundings on the side facing away from quenching. There was formed a uniform, stable planar flow funnel with its longitudinal axis parallel to the longitudinal axis of the spinning bar, and the otherwise occurring formation of a catenary along the threadline was suppressed. Apart from cooling the thread, the main function of the blow air is to stabilize the position of the filament bundle in the quench duct.

There was thus obtained a symmetrical temperature profile transverse to the longitudinal axis of the bar in contrast to the unsymmetrical temperature profile to be achieved with the otherwise usual cross-flow quenching (see Fourné, FIG. 3.12). In this way, Uster-HI values <0.5% are achieved.

The inventive process requires both the adjustment of a predetermined temperature profile by the above-described nozzle heating and the adjustment of a symmetrical blow air profile.

Due to the fact that the filaments disposed on the axis of the flow funnel are in an equilibrium of the frictional forces of the thread of the air supplied and the air sucked in, the deflection of the individual filaments transverse to the longitudinal axis of the spinning bar is less than 20 mm. According to Fourné(p. 195), deflections in the quench duct of 30–100 mm are otherwise usual.

Since the draft area is located close to the nozzle, the strong and early starting suction effect of the filament bundle prevents the balloon of the yarn from being blown through also in the upper portion of the quench duct. Therefore, a levelling of the pressure and a laminarization of the air sucked in from the surroundings is already necessary in this area. The amount of air sucked in in this area can directly be controlled via the specific adjustment of a pressure loss, for instance by a different number of fine fabric layers or perforated sheets.

Before reaching the filaments, the air sucked in is passed through a pressure levelling device and is possibly laminarized by guide members (e.g. straighteners).

The pressure loss caused by drawing off thread depends on the draw-off speed $V_{draw\text{-}off}$, the individual filament titer (in denier) and the filament count n according to the following relationship:

$$\Delta p = \rho_{air} \cdot \frac{v_{draw\text{-}off} \cdot n}{4,95 \cdot 10^5 \ \text{m/min}} (0,053 \, dpf^2_{final\,titer} - 0,40 \, dpf^2_{final\,titer} + 1,17)^2$$

To sufficiently supply the filaments with cooling air, the pressure loss to be applied in addition by a pressure levelling device should not be larger than (2 to 3)·Δp.

The individual thread bundles are separated by partitions such that a symmetrical air profile transverse to the longitudinal axis of the spinning bar is obtained. A preferred embodiment of the partitions is the arrangement of a partition common to two adjacent thread bundles on the parting axis (FIG. 4, to the left).

Figure 4:
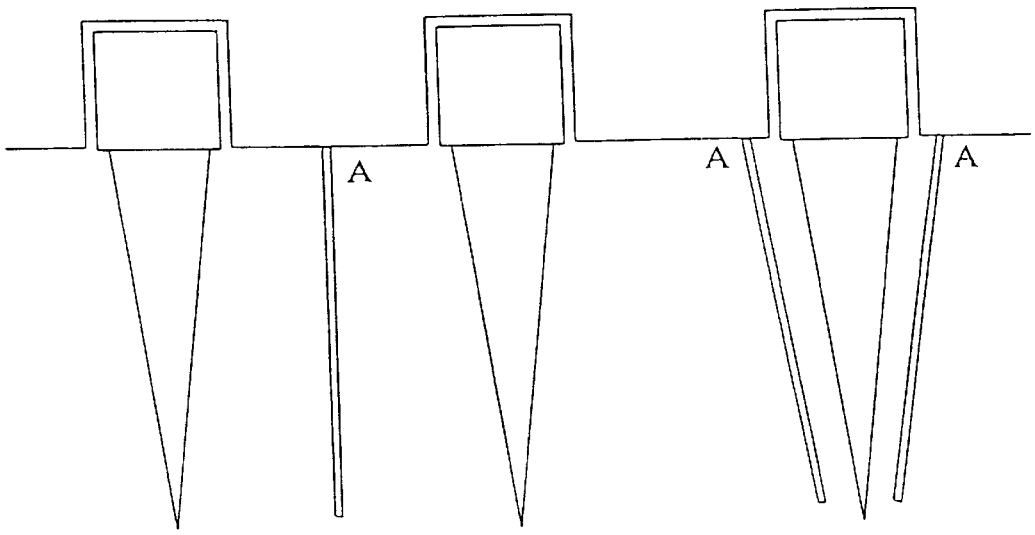

In another preferred embodiment, two partitions per thread bundle are each arranged so as to follow the threadline and be inclined in the direction of the thread axis, symmetrical to the same (FIG. 4, to the right). Sealing systems at the points A prevent stray air from being sucked in. The chambers thus formed are downwardly, rearwardly and forwardly open to the surroundings. For attenuating the compensating flow against the thread unwinding direction it is expedient to downwardly close the passage surface to such an extent that the filament bundle can just pass. The passage surface itself can be largely closed up to the thread bundle or be porous (e.g. perforated sheet), in order to exert a specific resistance to the compensating flow.

The process described above with reference to PET can analogously be applied to other polyesters or polyamides, where merely the different melting temperatures and viscosities should be considered.

EXAMPLE 1

PET polymer with an intrinsic viscosity of 0.635 dl/g was molten in a usual extruder and via static mixers and the product line was supplied to the spinning bar with a product temperature of 300° C. The spinning bar with six-way spinning pump, melt distributor and 6 nozzle packages was adjusted to 311° C. The flow rate per partial stream of the pump was 19.1 g/min. In the nozzle package, the melt was first pressed through two metal sand layers with increasingly fine grain size, then through a trimmed multilayer metal gauze filter whose finest layer consisted of a twill braid with 5 $\mu$m, subsequently through a distribution plate and a second trimmed multilayer metal gauze filter whose finest layer consisted of a twill braid with 15 $\mu$m, an untrimmed filter disk of metal gauze filter with 17,000 mesh/cm$^2$ lying flat directly on the nozzle plate and subsequently through the nozzle plate with a diameter of 96 mm, whose fine bores had a capillary diameter of 0.12 mm and a capillary length of 0.48 mm. The spacing of the fine bores on the nozzle plate was 5.8 mm.

The filaments emerging from the nozzle passed through an un-heated zone largely shielded from direct quenching directly after the nozzle with a length of 55 mm.

Directly after this area, the actual draft to almost the final speed was effected, where due to the higher radial heating applied in the package the middle and edge filaments approximately had the same speeds (checked by means of LDA measurement), before they subsequently entered a duct with cross-flow quenching divided in chambers all around, where they were exposed to blow air with a speed of 0.27 m/s, on a length of 1.5 m. The side opposite quenching was first of all shielded on a length of 150 mm with a combination of coarse screen with about 600 mesh/cm$^2$ and perforated sheet, and subsequently on a length of about 500 mm only with perforated sheet and holder. In the lower portion, conventional types of duct doors were used. Through this side, ambient air attenuated by means of a controlled self-suction of the filaments was supplied to the thread in the upper portion in about the same order of magnitude as on the blow side of cross-flow quenching.

485 mm after the exit from the spinneret, finish was applied to the filaments in a double oiler system, where oiler stones with special ceramic surfaces were used. There was applied an emulsion with a water content of <10%, where ⅔ of the amount applied onto the thread were supplied to the thread bundle in the first oiler and the remaining third was supplied in the second oiler. The thread tension measured behind the oiler was 26 cN. The bundled thread was passed on through the remaining quench duct over a length of 2 m, before it was exposed to an air pressure of 0.6 bar in an interlacer. There was used an interlacer with an adapted, special surface. The thread bundle was then directly supplied to the spooler via two galettes arranged in an S-shaped manner, controlled by means of a capillary breakage sensor and spooled with a tensile force of the thread of 7 g. There were obtained faultless spools with a good build-up. The final titer of the individual filaments was 0.21 dpf.

With these titers the risk of breakage is particularly pronounced. Therefore, all guiding members of ceramics (thread guide, oiler) getting in contact with the yarn were equipped with friction-pairing-optimized surfaces. The shape of the thread oilers also turned out to be decisive. When comparing the differences in tension before and behind the oiler with untreated and treated surface and correspondingly adapted shape, the tension could be reduced by up to 20% with correspondingly positive influences on the number of capillary breakages at the oiler. It is remarkable that upon interlacing no more local knots are formed in the yarn in contrast to standard yarns. There is preferably obtained a continuous interlacing, which leads to the fact that upon texturizing a very even bulky yarn is obtained.

On the spinning plant designed according to this process, any conventional titers can be employed in the usual fineness ranges for normal and high-count titers without major modifications.

EXAMPLE 2

The procedure was the same as in Example 1, but now the controlled self-suction opposite to cross-flow quenching was examined in conjunction with the strict chamber division between the thread bundles of a spinning position. The results are listed in Table 4:

TABLE 4

| Spinning titer [den] | Final titer [dpf] | Cross-flow quenching [m/s] | Controlled self-suction [m/s], chambering | Uster, half inert, [%] | Uster, normal test, [%] | Running properties | Spool evaluation |
|---|---|---|---|---|---|---|---|
| 74 | 0.21 | 0.27 | without, as well as without chambering | >0.8 fluctuating | >1 fluctuating | critical | fluffy |
| 74 | 0.21 | 0.27 | with, as well as with chambering | 0.6 | 0.8 | good | good |
| 90 | 0.26 | 0.27 | with, but without chambering | >0.8 fluctuating | >1 fluctuating | critical | satisfactory |

EXAMPLE 3

The procedure was the same as in Example 1, but the oiler design was varied, as explained in detail in Table 5. It was noted that beside the running stability the textile parameters are also influenced decisively:

TABLE 5

| Spinning titer [denier] | Final titer [dpf] | 1st Oiler Type | 2nd Oiler Type | Elongation at break [%] | Breaking strength [cN/tex] | Thread tension behind oiler [cN] | Running properties |
|---|---|---|---|---|---|---|---|
| 74 | 0.21 | friction-optimized shape and surface | friction-optimized shape and surface | 119.5 | 30.2 | 26 | good |
| 91 | 0.26 | conventional | friction-optimized shape and surface | 116.5 | 28.2 | 30 | critical |
| 91 | 0.26 | conventional | conventional | 111.9 | 22.5 | 32 | critical |

EXAMPLE 4

From the low bending resistance moment W of the yarn produced in accordance with the invention (e.g.: $W_{(0.26\ dpf)}=9\cdot10^{-18}\ mm^3 << W_{(1.0\ dpf)}=100\cdot10^{-18}\ mm^3$) there can so far not be derived an absolute necessity for an entangling, as a good compactness of the thread can already be expected by a self-interlacing of the filaments. With such a fine filament titer, the yarn can also be damaged in the interlacer. surprisingly, however, entangling in connection with the use of galettes turned out to be advantageous, as this ensures the safe guidance around the galettes, in particular with the necessary low spool tensions. Otherwise, a stable spinning run was difficult at least with texturizing finishes. Especially for the use of texturizing finishes, entangling before the galettes therefore turned out to be expedient. Although the highest spinning tensions occurring in the process are present there, no damages of the thread occur when using special surface-treated interlacers. As a result, usual galette surfaces could also be used for such fine titers.

Proceeding from filaments obtained in accordance with Example 1, the interlacer influence was examined, and the results are listed in Table 6.

TABLE 6

| Spinning titer [den] | Final titer [dpf] | Interlacer Type | interlacer Pressure | Elongation at break [%] | Breaking strength [cN/tex] | Running properties | Spool evaluation |
|---|---|---|---|---|---|---|---|
| 74 | 0.21 | without | 0 | 123 | 27.9 | critical | good |
| 74 | 0.21 | standard type | 0.6 | 115 | 25.2 | unsecure | fluffy |
| 74 | 0.21 | friction-optimized surface | 0.6 | 121.5 | 29.2 | good | good |

What is claimed is:

1. A process of producing a synthetic ultrafine endless yarn on the basis of polyester or polyamide in the range from 0.25 to 0.9 denier per POY filament by melt spinning at draw-off speeds between 2000 and 6000 m/min, characterized in that (i) as filtration medium in the spinning package there is used a sequence of different fabric layers with microfine mesh sizes of 5 to 15 μm in combination with or without fine steel sand with a grain size of 88 to 250 μm, and for shearing the melt there is used in the spinning package either steel sand or corresponding components with microfine pore holes of 50 to 1000 μm such that a total package pressure of at least 105 bar is achieved with filter surface loads of 0.25 to 0.80 g/min/cm$^2$, (ii) the hole density of the nozzle plates used lies between 1.5 and 6.0 hole/cm$^2$, (iii) the diameter d of the capillary bores in the nozzle plate is chosen with reference to the relationship $$d_{cap} = \sqrt[3]{\frac{533\cdot\dot{m}_{fil.}}{\rho_{melt}\cdot\pi\cdot\dot{\gamma}}}, \quad \text{with: } \dot{m}_{fil.} = v\cdot dpf_{POY},$$

such that the apparent wall shear rate of the melt inside the capillaries lies between 5,000 and 25,000 s$^{-1}$, (iv) the length L of the capillaries is chosen with reference to the relationship $$L = 1930\cdot\frac{\rho_{melt}\cdot d_{cap}^4}{\dot{m}_{fil.}\cdot(\eta_1-\eta_2\cdot\log\dot{\gamma})}\cdot\Delta p_{cap}\ [\text{mm}], \quad \text{where}$$

$$\dot{\gamma} = \frac{533\,\dot{m}_{fil.}}{\rho_{melt}\cdot\pi\cdot d_{cap}^3} \qquad \eta_1 = 3510 \qquad \eta_2 = 690$$

such that the melt pressure before the nozzle plate lies between 50 and 100 bar and preferably between 60 and 100 bar, (v) in the cross-section of the filament bundle before reaching the draft zone a balanced temperature profile is formed, where the distance h from the nozzle plate, on which this temperature profile is reached, is smaller than the distance of the solidification point $h_{0.98\%}$ from the nozzle plate, and the solidification point is chosen such that it is located directly subsequent to the protected snap-back and $h_{0.98\%}$ from the nozzle plate is defined by the following relationship:

$$h_{0.98\%} = 38\cdot\frac{9000\cdot\dot{m}_{fil}}{v_{draw\text{-}off}\cdot VV}\cdot\left(\frac{9000\cdot\dot{m}_{fil}}{v_{draw\text{-}off}\cdot VV}+6,0\right)\ [\text{mm}],$$

where $h_{0.98\%}$ is adjusted by means of the temperature of the polymer at the entrance of the spinning package in dependence on the filter surface load according to the following relationship: $T_{melt}$=308−25 $f_{filter}$ [° C.], $f_{filter}$ in g/min/cm$^2$, (vi) to reach the balanced temperature profile in the filament bundle, an excessive temperature ($T_{edge}$−$T_{edge}$) is adjusted, which as measured as surface temperature difference between the middle and the edge of the nozzle plate must be adjusted in the claimed range of titers by means of the temperature difference from spinning bar heating and polymer ($T_{melt}$−$T_{heating}$), in dependence on the filament throughput $m_{fil}$, the draw-off speed $V_{draw\text{-}off}$, and the filter area $A_{filter}$, as follows:

$$T_{heating} - T_{melt} = f \cdot (T_{edge} - T_{center})\left(-2,2 \cdot \frac{\dot{m}_{fil}}{0,141\ \text{g/min}} \cdot \frac{2600\ \text{m/min}}{v_{draw\text{-}off}} \cdot \frac{61\ \text{cm}^2}{A_{filter}}\right)$$

$$\text{with}\quad f = 14,3 \cdot e \quad \text{and} \quad 4\text{K} \le (T_{edge} - T_{center}) \le 13\text{K},$$

(vii) a precisely defined amount of heat, which is defined by the ratio l/t, is transferred to the partial polymer stream running on the outside in the spinning package, where l describes the length of the inner wall of the package along which the partial polymer stream running on the outside in the package is heated to an excessive temperature, and t describes the contact time available for the heat transfer with the inner wall of the package, approximately defined by the following relationship $$t = \frac{l \cdot A_Q \cdot \rho_{melt} \cdot \varepsilon}{n \cdot \dot{m}_{fil}},$$

where ϵ represents the part taken by the melt in a certain cross-section of the spinning package and may be constant in certain sections or may be a function of the height, and the ratio l/t is chosen within the following range:

$$0.6\ \text{cm/min} \le l/t \le 3.8\ \text{cm/min},$$

(viii) the still melt-liquid thread is not directly exposed to the blow air, but is first of all cooled in a so-called snap-back, the snap-back being smaller than the draft point, (ix) there is adjusted a speed profile of quenching which is symmetrical transverse to the longitudinal axis of the bar, where on the side facing away from quenching a controlled self-suction is effected by corresponding flow resistances, (x) the individual thread bundles are separated by partitions, (xi) all members getting in contact with the yarn, such as oilers, guide members and treatment members of ceramics, are equipped with friction-optimized surfaces, so that upon passage through the members there occurs a maximum build-up of tension in the yarn of 60 to 110%, (xii) selectively, the thread bundles are subjected to an entangling, and (xiii) the freshly spun yarn is spooled with a spooling tension, $$\sigma_{draw\text{-}off} = (0.5 \ldots 1.4)\frac{cN}{tex}.$$

2. The process as claimed in claim 1, characterized in that to the polyester or polyamide a second immiscible amorphous polymer is added in an amount of 0.05 to 5 wt %.

3. The process as claimed in claim 2, characterized in that the amorphous polymer is a copolymer which is composed of at least two of the following monomer units: 0 to 95 wt % A, where A is a monomer of the formula $CH_2$=C(R)—$COOR^1$, with R equal to —H or —$CH_3$ and $R^1$ equal to straight-chain or branched $C_{1\text{-}10}$ alkyl or cyclohexyl, 0 to 40 wt % B, where B is a monomer consisting of maleic acid or maleic anhydride, and 5 to 85 wt % C, where C is a monomer consisting of styrene or methyl-substituted styrene, and where (wt % A+wt % B+wt % C)=100.

4. The process as claimed in claim 1, characterized in that the dwell time of the melt inside the spinning package is adjusted by means of components such that it is not longer than 12 minutes and not shorter than 5 minutes.

5. The process as claimed in claim 1, characterized in that the partial melt stream close to the wall is heated to the required excessive temperature either on the entire length H of the melt-contacted inner wall of the spinning package or only on a part of the melt-contacted inner wall with an excessive temperature ($T_{heating}$−$T_{melt}$)×H/l which is increased corresponding to the area ratio H/l.

6. The process as claimed in claim 1, characterized in that the diameter d of the individual capillary bores in the nozzle plate is not constant over the cross-section of the nozzle plate, but is adapted inversely proportional to the temperature gradient as measured on the surface of the nozzle plate, where the difference between the central bores and the bores close to the edge is not more than 0.2 d.

7. The process as claimed in claim 1, characterized in that the yarn is spooled at draw-off speeds between 2000 and 6000 m/min and is subsequently processed on a stretch texturizing unit at speeds of 400 to 1000 m/min to obtain a final titer of 0.15 to 0.52 denier per filament.

8. The process as claimed in claim 1, characterized in that the yarn is spooled at draw-off speeds between 2000 and 6000 m/min and is subsequently processed on a stretching unit at speeds of 400 to 1000 m/min to obtain a final titer of 0.15 to 0.52 denier per filament.

9. The process as claimed in claim 1, characterized in that the yarn is stretched at draw-off speeds between 2000 and 6000 m/min to obtain a final titer of 0.15 to 0.52 denier per filament and is then spooled, where stretching to the final titer is effected upon spinning between two galette duos.

10. An ultrafine POY endless yarn on the basis of polyester or polyamide, to which selectively up to 5 wt % of a second immiscible amorphous polymer may be added, with a titer in the range from 0.25 to 0.9 denier per filament, an elongation at break of 100–145%, a specific breaking strength between 18 and 33 cN/tex and an evenness of the yarn, as expressed by the undamped Uster value, between 0.5 and 1.0%, characterized in that the yarn was obtained by the process according to claim 1.

11. An ultrafine stretched or stretch-texturized endless yarn on the basis of polyester or polyamide, to which selectively up to 5wt % of a second immiscible amorphous polymer may be added, with a titer in the range from 0.15 to 0.52 denier per filament, characterized in that the yarn was obtained by the process according to claim 7.

* * * * *